US005419728A

United States Patent [19]

Dallara

[11] Patent Number: 5,419,728

[45] Date of Patent: May 30, 1995

[54] DEVICE FOR FORMING SPHERICAL BUBBLES THAT CLING TOGETHER

[76] Inventor: Jane E. Dallara, 9 Idlewilde Dr., Palm Harbor, Fla. 34695

[21] Appl. No.: 223,918

[22] Filed: Apr. 6, 1994

[51] Int. Cl.[6] ..... A63H 33/28

[52] U.S. Cl. ..... 446/15

[58] Field of Search ..... 446/15–21; D21/61

[56] References Cited

U.S. PATENT DOCUMENTS

| | | | |
|---|---|---|---|
| D. 304,466 | 11/1989 | Brown | 446/15 |
| 1,205,123 | 11/1916 | Bradway | 446/19 |
| 2,305,382 | 12/1942 | Hagopian | 446/19 |
| 2,366,103 | 12/1944 | Hagopian | 446/19 |
| 2,527,935 | 10/1950 | Joel | 446/15 |
| 3,144,950 | 8/1964 | Rosenheim | 446/15 |
| 3,736,694 | 6/1973 | Lebensfeld | 446/16 |
| 4,128,962 | 12/1978 | Anderson | 446/15 |
| 4,180,938 | 1/1980 | La Fata et al. | 446/15 |
| 4,246,717 | 1/1981 | Wachtel | 446/19 |
| 5,071,382 | 12/1991 | Sanford | 446/15 |

FOREIGN PATENT DOCUMENTS

| | | | |
|---|---|---|---|
| 9202281 | 2/1992 | WIPO | 446/15 |

OTHER PUBLICATIONS

"Sudman's Bubble-ology Guide," Tangent Toy Co., 1984.

*Primary Examiner*—Robert A. Hafer
*Assistant Examiner*—Jeffrey D. Carlson
*Attorney, Agent, or Firm*—Joseph C. Mason, Jr.; Ronald E. Smith

[57] ABSTRACT

A device that forms bubbles that cling together in a predetermined configuration in the substantial absence of a large flat interface between the bubbles. In a preferred embodiment, the device includes a handle secured to a primary ring, and a plurality of secondary rings are secured to the primary ring in a predetermined pattern. The secondary rings are radially spaced apart from the primary ring by about one-sixteenth of an inch and are held in that position by a holding member. A pair of laterally spaced apart triangular openings are formed in each holding member, and each opening has a length of about one-sixteenth of an inch.

4 Claims, 2 Drawing Sheets

DEVICE FOR FORMING SPHERICAL BUBBLES THAT CLING TOGETHER

BACKGROUND OF THE INVENTION

1. Field of the Invention

This invention relates, generally, to devices that make bubbles. More particularly, it relates to a device that forms spherical bubbles and positions them in a predetermined pattern.

2. Description of the Prior Art

The surface tension of water is increased by many differing agents; perhaps the least expensive and most widely available surface tension-increasing agent is found in household soap. It was discovered long ago that soapy water would form into a flat sheet if an open frame member were immersed into the water and removed therefrom; the surface tension holds the soapy water to the open frame and a flat sheet of soapy water fills the void surrounded by the frame. Causing air to impinge against the sheet of soapy water then causes the peripheral edge of the flat sheet to separate from the edges of the open frame and to reassemble into a perfect sphere.

Air is caused to impinge against the soapy water by holding the frame still and blowing against the film by human or mechanical means or by simply waving the open frame member through the air. The open frame member and its handle are often called a wand because of such latter use.

There have been numerous innovations in the field of bubble-making devices. A globular cluster of bubbles was formed by the soap bubble pipe invented by Mausolf in 1936 (U.S. Pat. No. 2,041,423 and Des. Pat. No. 98,687). This design causes three bubbles to merge with one another along large flat planes; thus, the bubbles are far from spherical because they have large flat areas where they interface with one another.

Tseng U. S. Pat. No. 2,836,926 shows a multi-bubble device where all of the bubbles form perfect spheres, but none of the bubbles touch another bubble.

Rasmussen U.S. Des. Pat. No. 263,062 shows a multi-bubble device where all of the bubbles form a perfect sphere, but the bubbles separate from one another as soon as they are formed.

Hagopian, U.S. Pat. No. Des. 139,940, shows a device that produces a single clover-shaped bubble.

Still further innovations of interest are disclosed in Joel, II U.S. Pat. No. 2, 527,935 (forms a bubble within a bubble), and Great Britain patent No. 1,329,796 (also forms a bubble within a bubble).

Although the art of bubble-forming is quite well-developed, it has not produced a wand capable of making plural bubbles, each of which forms a substantially perfect sphere, each of which remains attached to a contiguous bubble after formation, each of which substantially maintains its position relative to the other bubbles after all of the bubbles have been formed, and each of which adjoins its contiguous bubble with a flat interface area that is smaller in size than the flat interface areas heretofore known.

SUMMARY OF THE INVENTION

The present invention advances the art of bubble making by disclosing the world's first wand that produces multiple substantially spherical bubbles that cling to one another after formation in a predetermined pattern in the substantial absence of migration and in the substantial absence of large flat abutting surfaces.

The novel wand includes a conventional handle that is fixedly secured to a primary bubble-forming circular open frame member. In a first embodiment, a secondary bubble-forming circular open frame member is fixedly secured to the primary open frame member by a unique holder means that enables the formation of the final desired bubble structure. The two bubbles meet along a common tangent, i.e., there is a small flat interface surface therebetween so both bubbles remain substantially spherical.

In a second embodiment, two additional bubble-forming open frames are secured to the first, and the resulting bubble has a mouse-like appearance. A novel soapy water storage means may be provided in connection with each of the three embodiments.

The unique holder means for connecting contiguous open frame members to one another performs the function of holding the primary and secondary open frame members about one-sixteenth of an inch apart from each other. Moreover, a pair of triangular-shaped air openings are formed in each holder means. This spacing of the open frame members and the air openings ensures that the resulting bubbles will substantially maintain their respective positions once formed, and will not form large flat surfaces where they abut one another.

It should now be clear that the primary object of this invention is to provide a bubble-forming wand that produces multiple substantially spherical bubbles that maintain their respective positions relative to one another after formation and which abut one another along tangent lines and thus maintain their substantially spherical shapes.

Another object is to advance the art of bubble wands by providing a bubble wand having a storage means to which soapy water clings.

An additional object is to provide the world's first bubble wand capable of forming a mouse-like collection of substantially spherical bubbles.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
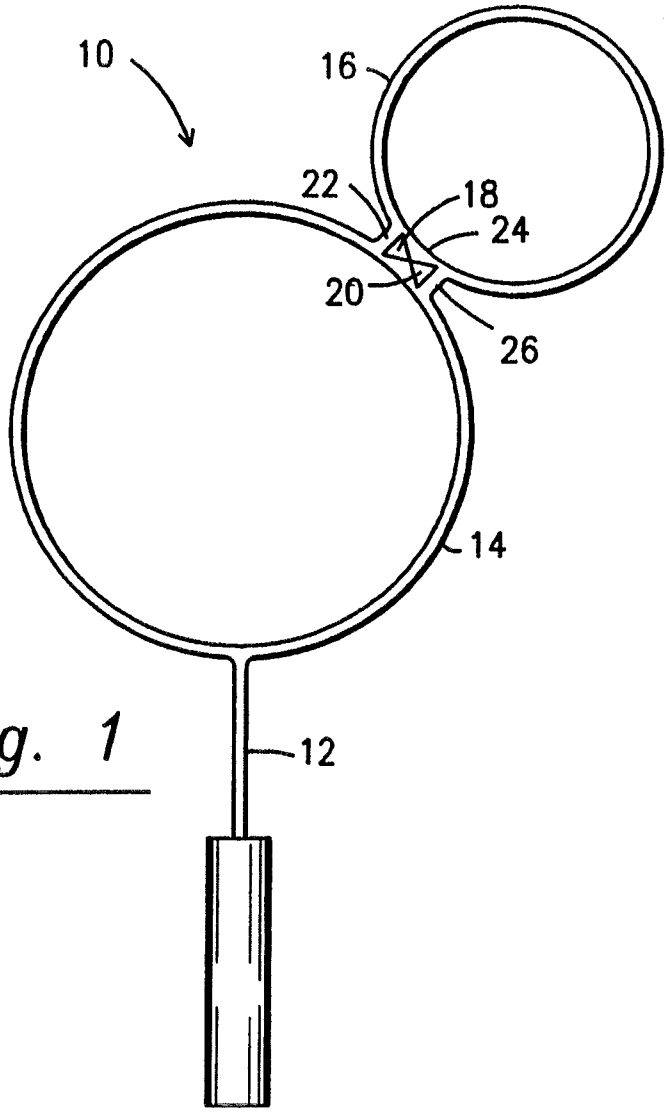
FIG. 1 is a front elevational view of a first illustrative embodiment of the invention.

Referring now to FIG. 1, it will there be seen that a first exemplary embodiment of the invention is denoted as a whole by the reference numeral 10. Handle 12 may be straight, bent, arcuate, curvilinear, or the like and may have a cross section of any predetermined geometrical configuration; it forms no part, per se, of the invention.

Primary ring 14 has a predetermined diameter greater than the predetermined diameter of secondary ring 16; said ratio is not critical to the invention, i.e., the primary and secondary rings may be of equal size and the secondary ring may be larger in diameter than the first.

A holder means joins the primary and secondary rings together in specific, spaced apart relation to one another. A pair of triangular-shaped openings 18 and 20 are formed in the holder means as shown; they allow air to pass therethrough and are believed to be responsible for the unique bubble structures made possible by this invention. Each opening is about one-sixteenth of an inch in length and about the same size at its widest part. Note that the respective openings exhibit bilateral symmetry with respect to one another, i.e., they are horizontally flipped with respect to one another.

The handle 12 and each ring 14 and 16 may be made of any suitable material such as wire or plastic, the latter being preferred. Where the parts are made of wire, they may be soldered together, and the openings 18, 20 are thus formed by three globular clusters 22, 24, and 26 of solder. Where the parts are made of plastic, openings 18, 20 are formed by three plastic formations, also represented by the reference numerals 22, 24, and 26. The three formations 22, 24, 26 and the openings 18 and 20 collectively form the holding means of this invention.

As mentioned above, the radial spacing between the primary and secondary ring is about one-sixteenth of an inch. This spaces the bubbles slightly apart from one another at the time of their formation. When the bubbles form, contiguous bubbles then approach one another and connect with one another along a tangent, i.e., in the absence of a large flat interface. If the radial spacing is substantially less than one-sixteenth of an inch, the bubbles separate from one another. If the radial spacing is substantially greater than one-sixteenth of an inch, the bubbles form unrecognizable clusters with large, flat interfaces.

Figure 2:
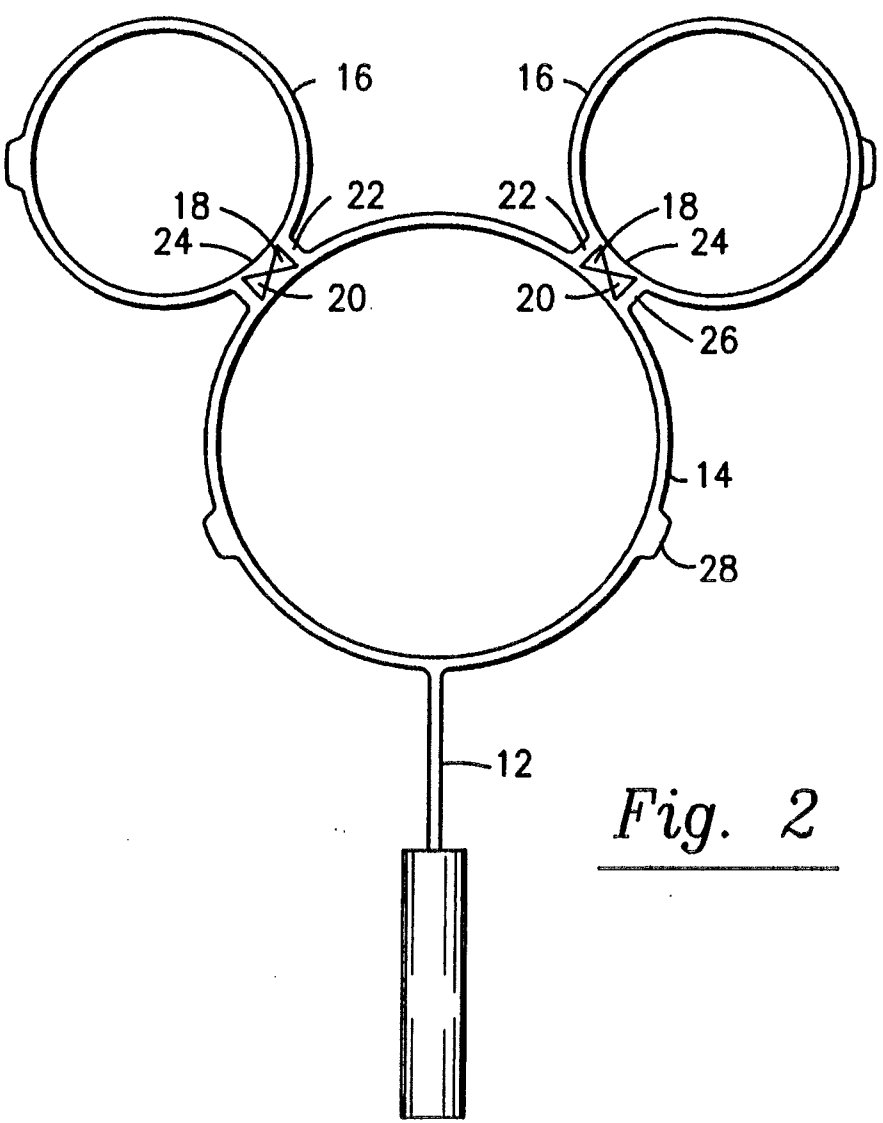
FIG. 2 is a front elevational view of a second illustrative embodiment thereof.

The second embodiment of this invention is depicted in FIG. 2; it includes a second secondary ring 16. Reference numeral 28 denotes a globular cluster or flat plate of solder, plastic, or other tab-shaped suitable substrate upon the surface of which soapy water is collected in accordance with another important teaching of this invention. Tab 28 may have a round, flat, or other configuration, although a spherical configuration provides the greatest surface area upon which soapy water may collect. When the rings are immersed within a reservoir of soapy water (not shown), some of that soapy water will collect upon the surface of storage means 28; as the bubbles form, soapy water from said storage means flows into and joins the soapy water forming the bubble, thereby producing bubbles having a film thicker than would be produced in the absence of such storage means.

Figure 3:
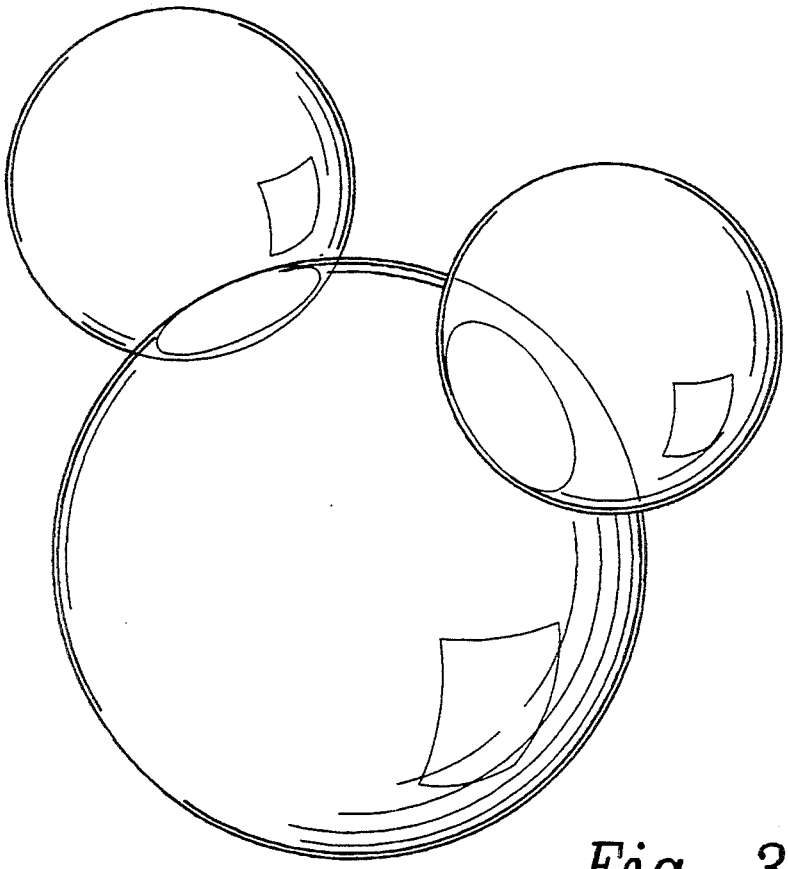
FIG. 3 is a perspective view of the bubbles produced by the wand of the second embodiment.
Figure 4:
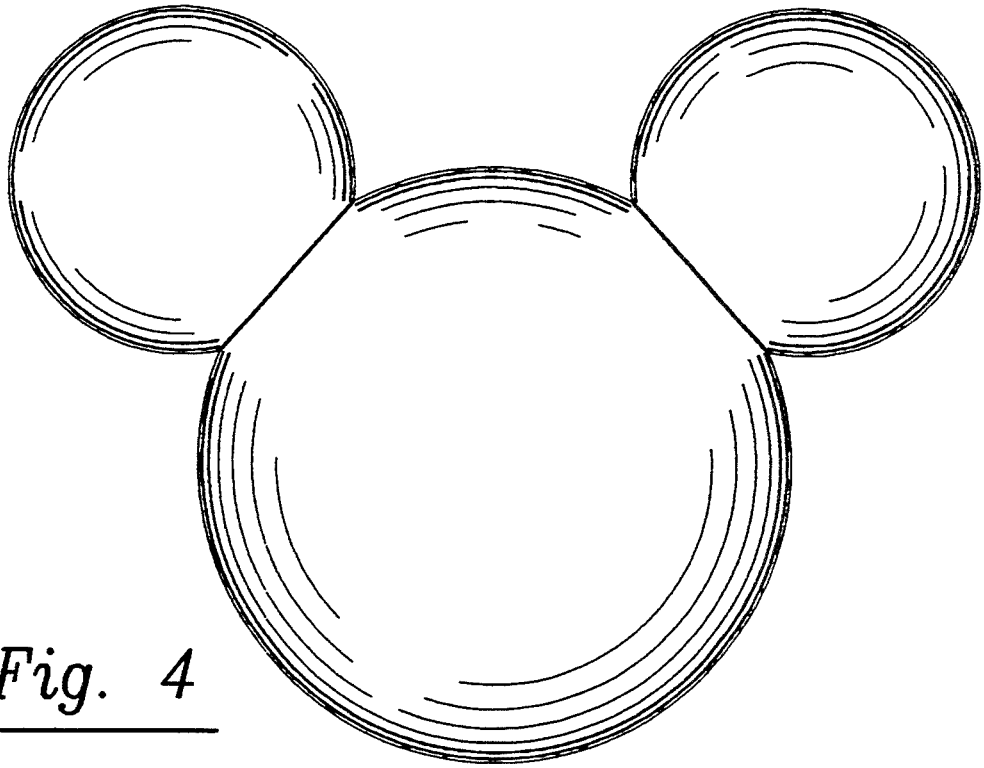
FIG. 4 is a front elevational view of the bubbles depicted in FIG. 3.

The bubbles produced by the second embodiment are depicted in FIGS. 3 and 4. Note the substantial absence of large, flat interfaces. Just as importantly, it should be appreciated that the bubbles generally remain in their depicted positions after formation, although sometimes the two "ears" tend to migrate toward one another.

In all embodiments, primary ring 14 is depicted as having a diameter greater than the secondary ring or rings, but a construction where all of the rings share a common diameter is within the scope of this invention, as is a construction where the rings have differing diameters and form shapes other than cartoon-like mice.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A device that forms substantially spherical bubbles that join and cling to one another comprising:

a primary ring member having a first diameter;

said primary ring member having an outer perimeter;

a pair of secondary ring members having a common second diameter;

each secondary ring member of said pair of secondary ring members having an outer perimeter spaced radially outwardly of said outer perimeter of said primary ring;

said first diameter being greater than said second diameter;

said secondary ring members being circumferentially spaced apart from one another about the outer perimeter of said primary ring member;

a pair of holder means for joining said primary and secondary ring members in said radially spaced relation to one another;

a pair of laterally spaced openings formed in each of said holder means to allow air to pass therethrough; and a handle means secured to said primary ring member.

2. The device of claim 1, wherein said holder means holds said primary and secondary ring members about one-sixteenth of an inch in said radial direction apart from one another, and wherein each opening of said pair of laterally spaced openings is triangularly shaped.

3. The device of claim 2, wherein each of said triangularly shaped openings has a length of about one-sixteenth of an inch.

4. The device of claim 1, further comprising a flat storage means, for storing soapy water, fixedly secured to a radially outward side of said outer perimeters of said primary and secondary ring members at a preselected location thereon, said flat storage means being coplanar to said primary and secondary ring members.

* * * * *